US006897887B2

(12) United States Patent
Miyajima et al.

(10) Patent No.: US 6,897,887 B2
(45) Date of Patent: May 24, 2005

(54) HEAT HISTORY CONTROL SYSTEM, PRINTER, AND PROGRAM

(75) Inventors: Takeo Miyajima, Kanagawa (JP); Kei Suzuki, Kanagawa (JP)

(73) Assignee: NEC Infrontia Corporation (JP)

( * ) Notice: Subject to any disclaimer, the term of this patent is extended or adjusted under 35 U.S.C. 154(b) by 125 days.

(21) Appl. No.: 10/623,532

(22) Filed: Jul. 22, 2003

(65) Prior Publication Data

US 2004/0119806 A1 Jun. 24, 2004

(30) Foreign Application Priority Data

Jul. 29, 2002 (JP) ..... 2002-219830

(51) Int. Cl.[7] ..... B41J 2/36; B41J 2/365
(52) U.S. Cl. ..... 347/195
(58) Field of Search ..... 347/188, 195; 400/120.09, 120.15

(56) References Cited

U.S. PATENT DOCUMENTS 4,709,149 A * 11/1987 Takahashi et al. ..... 250/317.1
5,548,688 A * 8/1996 Wiklof et al. ..... 358/1.8
6,008,831 A * 12/1999 Nakanishi et al. ..... 347/195

FOREIGN PATENT DOCUMENTS

JP 4-146158 5/1992

* cited by examiner

*Primary Examiner*—Huan Tran
(74) *Attorney, Agent, or Firm*—Dickstein, Shapiro, Morin & Oshinsky, LLP.

(57) ABSTRACT

A memory stores printing data. A CPU reads, from the memory, printing data on a target line to be printed subsequently and printing data on a plurality of immediately preceding lines, performs an arithmetic operation with respect to the read printing data to determine a history pattern, stores the determined history pattern in the memory, reads, from the memory, the history pattern of a history factor which is a dot exerting the influence of heat accumulation on a target dot to be printed subsequently, transmits the read history pattern to a thermal print head interface unit, and transmits a history timer value preliminarily allocated to the history factor to the thermal print head interface unit. The thermal print head interface unit drives a thermal print head based on the history pattern and on the history timer value.

23 Claims, 9 Drawing Sheets

IDEAL CHARACTERISTICS

ACTUAL CHARACTERISTICS
(UNDER NO CONTROL)

HEAT HISTORY CONTROL SYSTEM, PRINTER, AND PROGRAM

BACKGROUND OF THE INVENTION

1. Field of the Invention

The present invention relates to a heat history control system and to a printer and, more particularly, to a heat history control system for a thermal print head and to a printer using the heat history control system.

2. Description of the Related Prior Art

Conventionally, a thermal printer which performs printing by using a thermal print head has been used. To maintain print quality in the thermal printer, it is necessary to perform heat history control for the thermal print head. An example of the heat history control for the thermal print head is disclosed in Japanese Laid-Open Patent Publication No. HEI 4-146158.

In a small-size thermal printer to be mounted on, e.g., a POS apparatus or the like, it is frequently performed to select a low-performance and low-cost microprocessor or lower the capacity of a memory such as a RAM or ROM for the purpose of cost reduction. As faster printing and higher print quality are pursued, however, it is difficult in most cases to obtain satisfactory performance with these structures. To satisfy the demands, it is an essential requirement to externally provide a special-purpose printing control circuit and minimize a process performed by the processor. FIG. 1 is a block diagram showing a prior-art technology, in which a heat history control circuit 144 is provided in a thermal print head interface LSI 104. However, the provision of a special-purpose printing control circuit leads to the problems of a complicated structure and increased cost.

SUMMARY OF THE INVENTION

A heat history control system in a embodiment of the present invention comprises: a CPU; a memory; a thermal print head having a heat generating element; and a thermal print head interface unit. The memory stores printing data. The CPU reads, from the memory, printing data on a target line to be printed subsequently and printing data on a plurality of immediately preceding lines, performs an arithmetic operation with respect to the read printing data to determine a history pattern, stores the determined history pattern in the memory, reads, from the memory, the history pattern of a history factor which is a dot exerting influence of heat accumulation on a target dot to be printed subsequently, transmits the read history pattern to the thermal print head interface unit, and transmits a history timer value preliminarily allocated to the history factor to the thermal print head interface unit. The thermal print head interface unit drives the thermal print head based on the history pattern and on the history timer value.

A printer in a embodiment of the present invention comprises: a CPU; a memory; a thermal print head having a heat generating element; and a thermal print head interface unit. The memory stores printing data. The CPU reads, from the memory, printing data on a target line to be printed subsequently and printing data on a plurality of immediately preceding lines, performs an arithmetic operation with respect to the read printing data to determine a history pattern, stores the determined history pattern in the memory, reads, from the memory, the history pattern of a history factor which is a dot exerting influence of heat accumulation on a target dot to be printed subsequently, transmits the read history pattern to the thermal print head interface unit, and transmits a history timer value preliminarily allocated to the history factor to the thermal print head interface unit. The thermal print head interface unit drives the thermal print head based on the history pattern and on the history timer value.

A program in a embodiment of the present invention allows a computer to perform the process steps of: reading, from a memory, printing data on a target line to be printed subsequently and printing data on a plurality of immediately preceding lines; performing an arithmetic operation with respect to the read printing data to determine a history pattern; storing the determined history pattern in the memory; reading, from the memory, the history pattern of a history factor which is a dot exerting influence of heat accumulation on a target dot to be printed subsequently; transmitting the read history pattern to a thermal print head interface unit; and transmitting a history timer value preliminarily allocated to the history factor to the thermal print head interface unit.

BRIEF DESCRIPTION OF THE DRAWINGS

The above and other objects, features and advantages of the present invention will become more apparent from the following detailed description when taken with the accompanying drawings in which.

DETAILED DESCRIPTION OF THE PREFERRED EMBODIMENTS

As one of printing methods for a printer, there is a thermal method using a thermal print head. The thermal method is subdivided into a direct thermal method which allows color production by heating a heat-sensitive sheet with a thermal print head and a thermal transfer method which transfers ink onto a sheet by heating an ink film with a thermal print head. In the present invention, a printer using a direct thermal method and a printer using a thermal transfer method will be termed generally thermal printers.

In a thermal printer, heat history control over a thermal print head is performed. Heat history control is defined herein as control performed by referring to previous printing history to suppress the influence of heat accumulation resulting from a previous printing operation on a dot to be printed subsequently.

Figure 1:
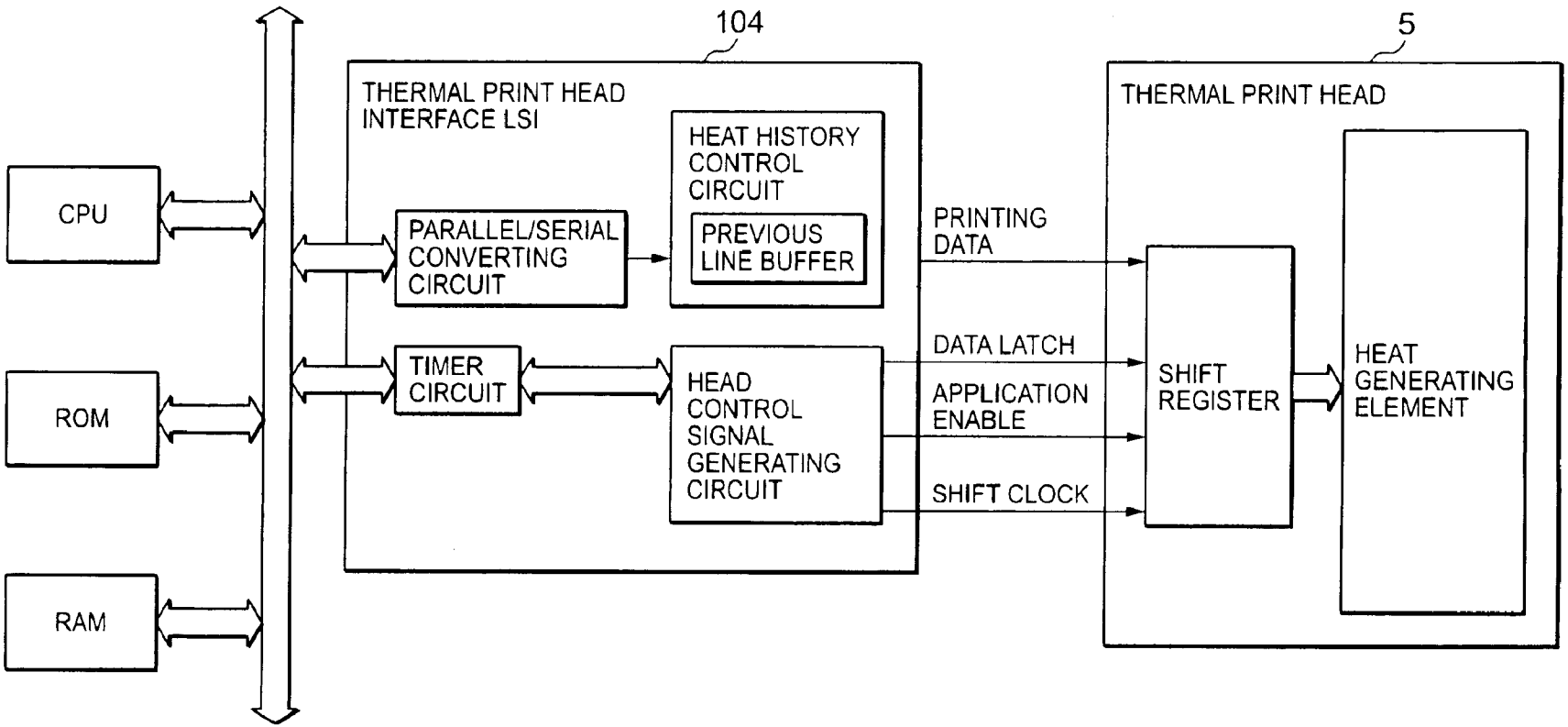
FIG. 1 PRIOR ART
FIG. 1 is a block diagram showing a conventional heat history control system.
Figure 2:
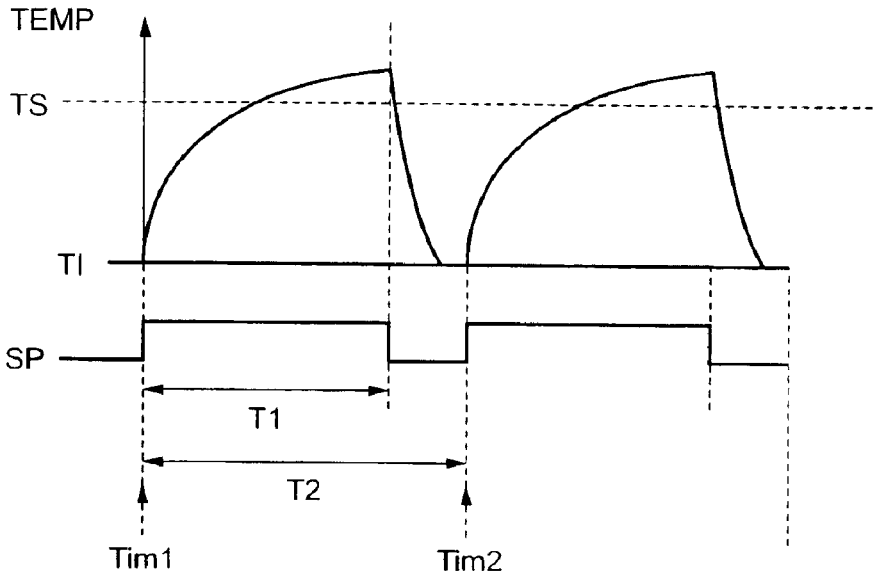
FIG. 2 is a view showing ideal thermal characteristics of a thermal print head.

A description will be given to the outline of heat history control. FIG. 2 is a view showing ideal thermal characteristics of a thermal print head. As shown in the drawing, the surface temperature of the head increases from an initial temperature TI in accordance with a given time constant during the ON period of an applied signal SP. If the temperature then returns to the initial temperature TI during the period between the switching OFF of the applied signal SP and the subsequent application timing Tim2, the applied signal SP is allowed to have a constant pulse width in any case. If the thermal print head has the ideal characteristics, therefore, there is no need for heat history control.

Figure 3:
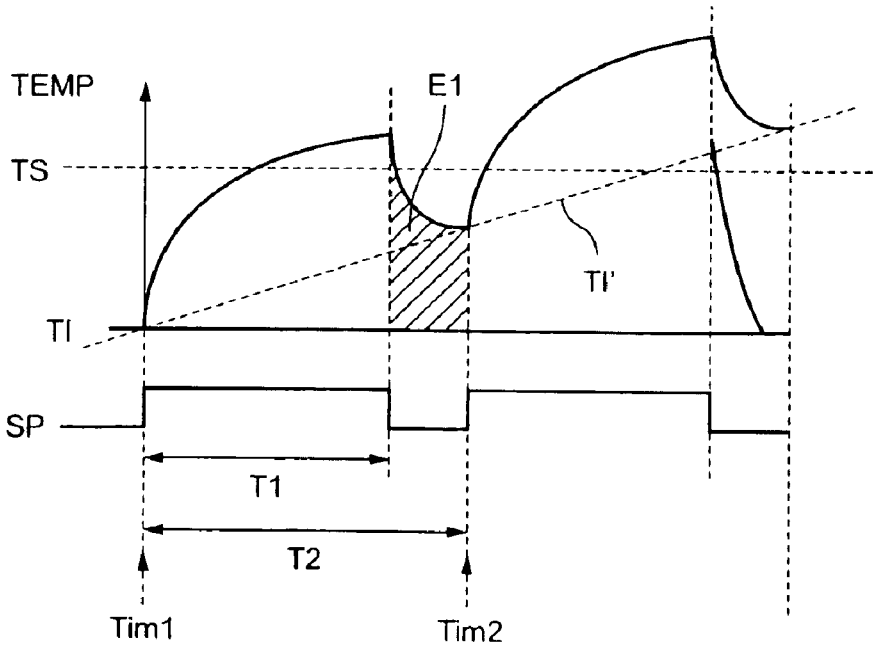
FIG. 3 is a view showing actual thermal characteristics of a thermal print head.

FIG. 3 is a view showing actual characteristics of a thermal print head. Under the influence of accumulated heat E1, the surface temperature of the thermal print head does not lower to the initial temperature TI by the time the subsequent application timing Tim2 is generated even when the applied signal SP is turned OFF. This phenomenon is more likely to occur when the printing speed is increased because the application cycle T2 becomes shorter, though it is also dependent on the thermal characteristics of the thermal print head. The influence of the accumulated heat hinders high-speed printing.

In the thermal printer, heat accumulated in a dot to be printed subsequently is assumed by referring to an image of dots printed previously. The pulse width of the applied signal SP is adjusted so that constantly uniform thermal energy is applied to the thermal print head.

The printing history for several lines is held after the completion of printing and a previously printed dot having a possibility of exerting the influence of heat accumulation on a dot to be printed subsequently is examined. If the dot of concern was printed previously, it can be considered that the dot will exert greater influence of heat accumulation than in the case where no printing was performed so that an energization time for the thermal print head is reduced. The accumulated heat has different degrees of influence depending on the number of dots printed previously and on the positions of the dots. The previous printing history is modeled in accordance with a given pattern and each of dots composing the model (hereinafter referred to as the history factor) is temporally weighed. Thereafter, the position at which the dot was printed previously is determined and the time corresponding to the printed history factor is subtracted from the overall application time.

Figure 4:
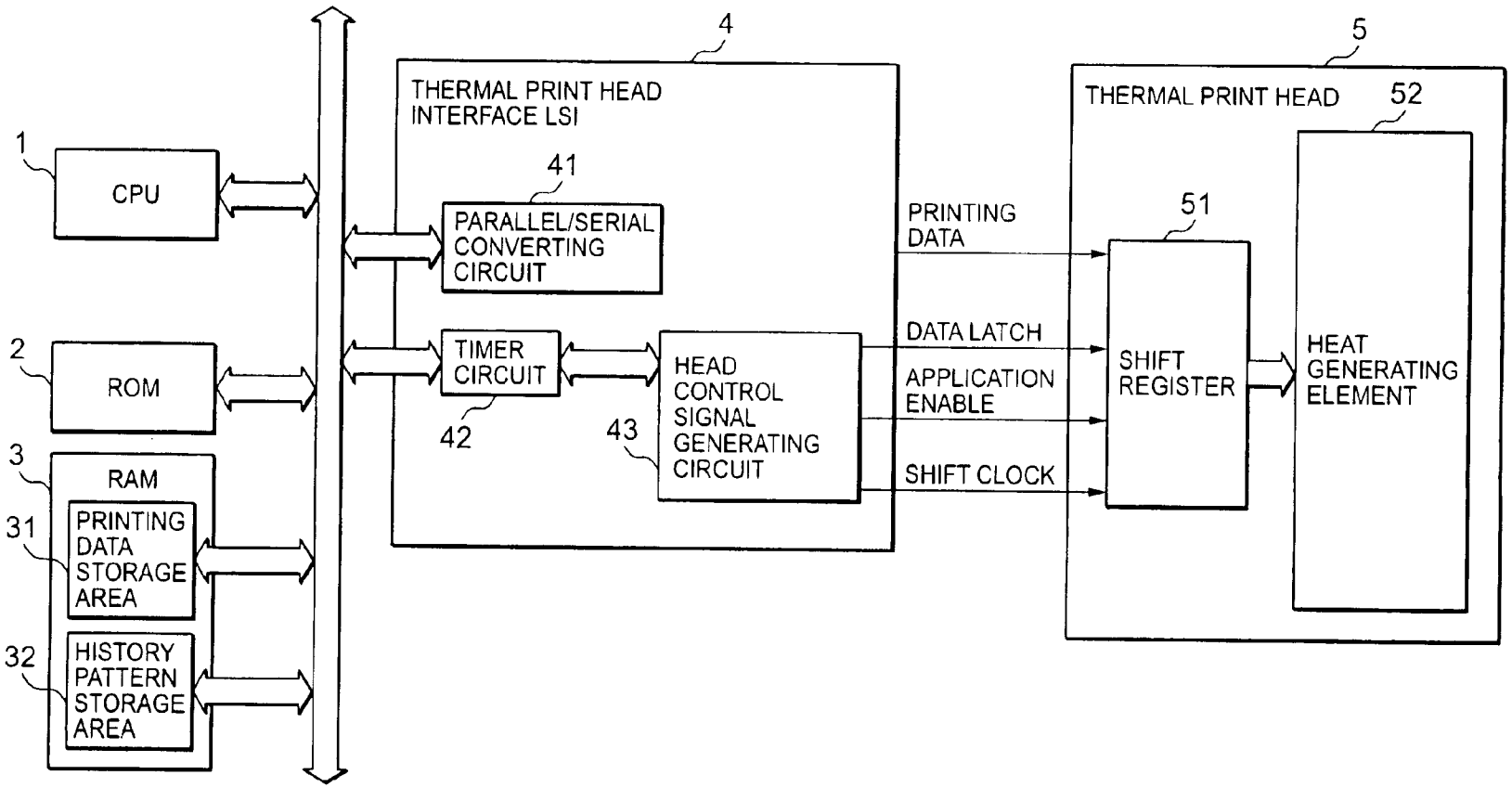
FIG. 4 is a block diagram showing a embodiment of a heat history control system according to the present invention.

FIG. 4 is a block diagram showing the structure of a embodiment of the present invention. A heat history control system includes a CPU 1, a ROM 2, a RAM 3, a thermal print head interface LSI 4, and a thermal print head 5.

The CPU 1 refers to previously printed dots and executes the process of generating a history pattern for each of history factors in accordance with a heat history control algorithm stored in the ROM 2.

The RAM 3 includes a printing data storage area 31 and a history pattern storage area 32. The printing data storage area 31 holds an image of dots in a line to be printed subsequently and images of dots in several lines the printing of which has already been completed. The number of previously printed lines held in the printing data storage area 31 is increased if, e.g., high-accuracy heat history control is to be performed and reduced if simple heat history control is sufficient. As the number of printed lines stored in the printing data storage area 31 is larger, the number of history factors is increased so that higher-accuracy heat history control is allowed. The history pattern storage area 32 stores the result of an arithmetic operation performed by the CPU 1 based on the previous printing data on a per history-factor basis.

The thermal print head interface LSI 4 is provided with a circuit for interfacing with the thermal print head 5 and includes a parallel/serial converting circuit 41, a timer circuit 42 and a head control signal generating circuit 43. The parallel/serial converting circuit 41 converts parallel data in a bus interface to serial data. The timer circuit 42 performs a time counting operation based on a history timer value which is a time allocated to each of the history factors. The head control signal generating circuit 43 generates a control signal for a shift register 51 provided in the thermal print head 5 in accordance with a timing generated by the timer circuit 42.

Figure 5:
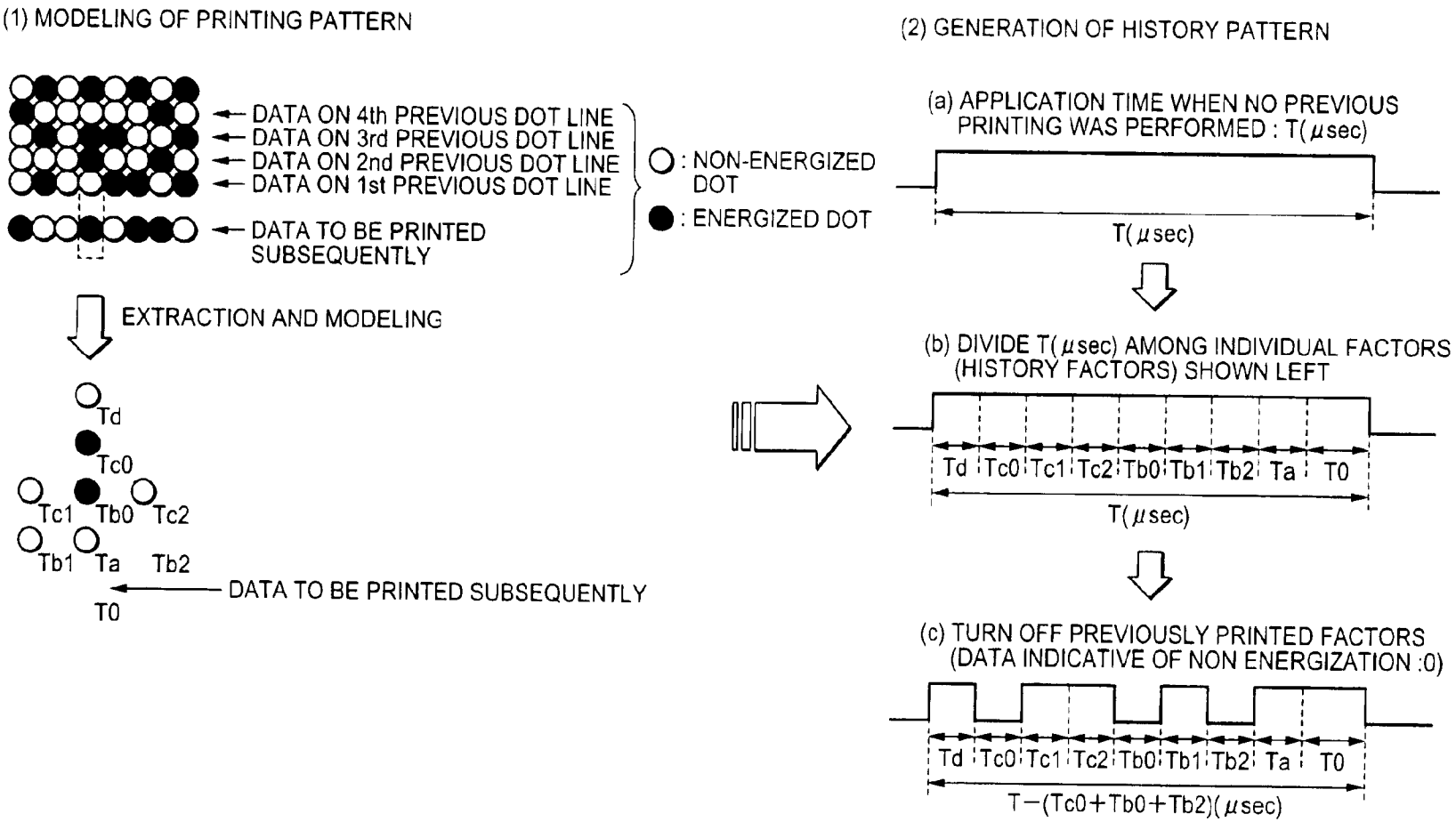
FIG. 5 (including parts (1) and (2)) is a view showing the outline of a heat history control operation according to the present invention.

FIGS. 5(1) and 5(2) are views showing the outline of a heat history control operation according to the present invention. First, as shown in FIG. 5(1), images of dots in data to be printed subsequently and in the previous four lines are held and modeled in accordance with a given pattern.

As shown in FIG. 5(2), an application time required when no printing was performed previously is designated as T and the application time T is divided among previous printing factors (history factors) that have been modeled. At this time, the allocation of time to each of the history factors resulting from the division is determined based on the degree of influence of heat accumulation exerted by the history factor on a dot to be printed subsequently. The time allocated to each of the history factors is termed a history timer value. In the model shown in FIG. 5(1), e.g., a 1st previous dot Ta has a higher degree of influence of heat accumulation on a dot to be printed subsequently than a dot Tc0 in a third previous line. Accordingly, the time allocated to the dot Ta is normally larger than the time allocated to the dot Tc0. Then, attention is focused on the dot T0 to be printed subsequently and the history factors printed previously are examined. As data indicative of no energization of the portion corresponding to the printed history factor, "0" is set, while "1" is set as data indicative of energization of the portion corresponding to the unprinted history factor. Specifically, the application time corresponding to thermal energy which theoretically causes color production on a heat-sensitive sheet under the condition that history control is ignored is designated as T and, if there is any history factor printed previously, the time corresponding to the printed history factor is subtracted from the application time T, whereby the time for the applied signal TS is adjusted.

In the example shown in FIGS. 5(1) and 5(2), the three dots Tb2, Tb0, and Tc0 were printed previously in association with the dot T0 to be printed subsequently. It can be considered that, compared with the case where no printing was performed previously, heat accumulation has occurred as a result of application to the three points. Therefore, thermal energy is corrected by assuming that the application time=T−(Tb2+Tb0+Tc0) is satisfied. By this time, times weighed in accordance with the respective degrees of influence of heat accumulation on the dot T0 have been allocated in advance to the dots Tb2, Tb0, and Tc0.

The same process is performed with respect to each of the dots in one line and the result of the process is transferred on a per history-factor basis to the thermal print head 5. To print one line of dots, therefore, data for application is transferred a plurality of times (in the present embodiment, nine history factors including the factor T0 relative to the position of the dot to be printed subsequently) to the thermal print head 5.

A detailed description will be given next to the operation. In the printing data storage area 31 of the RAM 3, the images of dots to be printed subsequently and the dots in the first to fourth previously printed lines are stored. Upon the initiation of a printing operation, the CPU 1 generates a history pattern by using a history pattern generation algorithm stored in the ROM 2.

Figure 6:
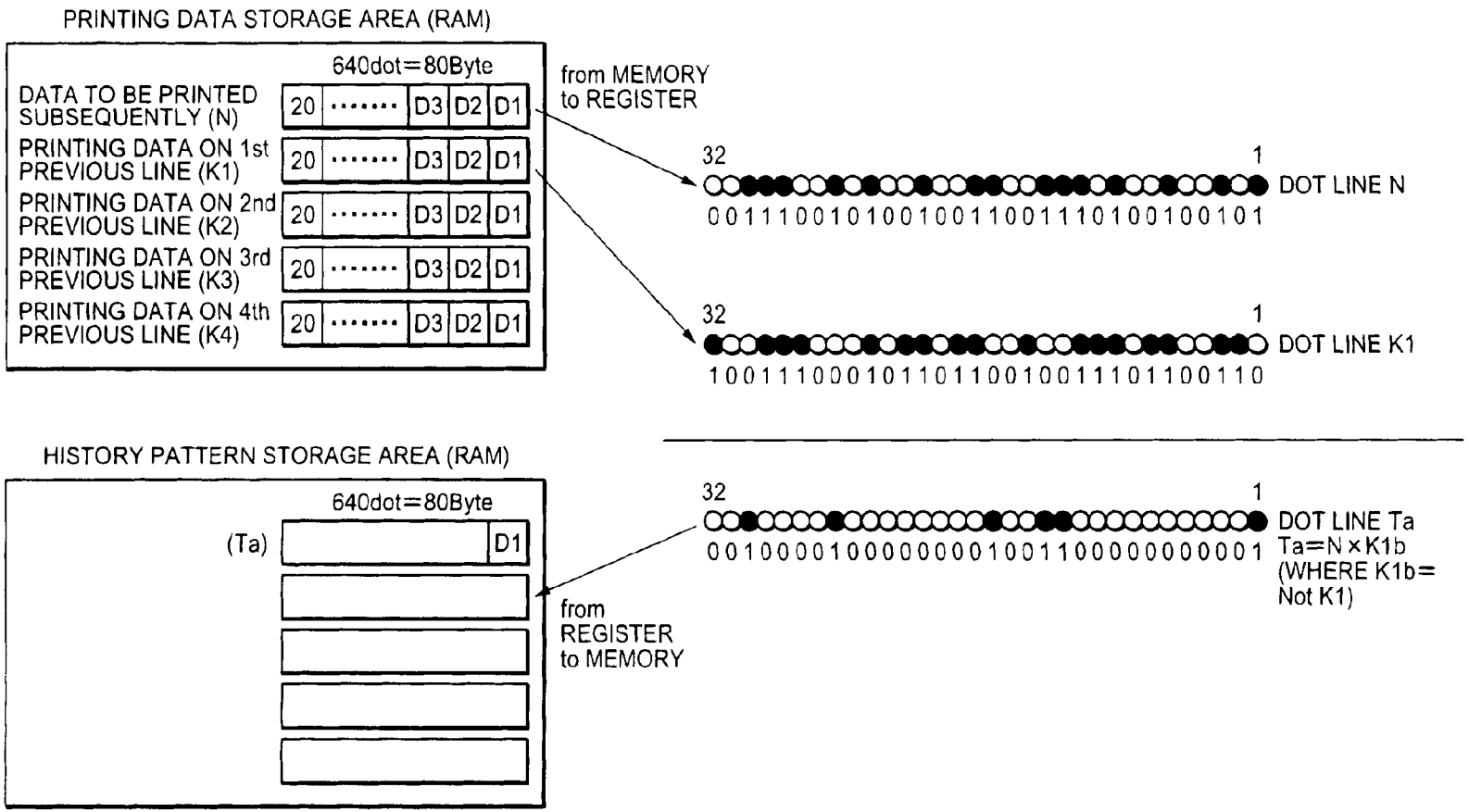
FIG. 6 is a view showing an example of a history pattern generation algorithm.

FIG. 6 is a view showing an example of the history pattern generation algorithm. First, the CPU 1 generates a history pattern for the dot Ta as the first history factor. The CPU 1 loads the lowest 32 bits of printing data (N) to be printed subsequently, and the lowest 32 bits of printing data (K1) on the 1st previous line, from the printing data storage area 31 into an arithmetic register in the CPU 1. Although the CPU 1 performs loading on a 32-bit basis in the present embodiment, loading is performed in an appropriate size if the CPU 1 has a 16-bit or 8-bit internal register. After loading individual sets of printing data, the CPU 1 performs an arithmetic operation with respect to a history pattern. The arithmetic expression shown in FIG. 6 is an example of the expression for generating a history pattern corresponding to the history factor Ta. The CPU 1 first determines whether or not each of dots to be printed subsequently is a energized dot and, if it is a non-energized dot, unconditionally sets data "0" indicative of no energization. The CPU 1 then performs an arithmetic operation in accordance with the procedure for generating a history pattern such that "0" is set if printing was performed at the position of the dot Ta as the first history factor and that "1" is set if printing was not performed at the position of the dot Ta. The CPU 1 stores the result of the arithmetic operation in the history pattern storage area 32. Since 1 line is composed of 640 dots in the present embodiment, the CPU 1 performs the process with respect to 1 line, i.e., to 640 bits, and then completes the generation of the history pattern.

Then, the CPU 1 generates a history pattern corresponding to the dot Tb1 as the second history factor. As shown in FIG. 5, the dot Tb1 is positioned on the left side of the 1st previous dot Ta when viewed from the dot T0 to be printed subsequently. After loading printing data (K1) on the 1st previous line from the printing data storage area 31 into the arithmetic register, the CPU 1 performs a 1-bit right shift operation and then performs an arithmetic process with respect to the history pattern. At that time, the CPU 1 preliminarily examines the value of the 33rd bit and, if it is "1", performs an additional arithmetic operation of setting "1" to the most significant bit after the right shift operation. The present embodiment has been described on the assumption that "0" is set (see FIG. 7). After that, the CPU 1 sequentially stores the results of the arithmetic operations in the history pattern storage area 32 in the same manner as it did for the dot Ta and repeatedly performs the process a number of times corresponding to 1 line. As shown in FIG. 5, the dot Tb2 as the third history factor is positioned on the right side of the 1st previous dot in opposite relation to the dot Tb1. Accordingly, the CPU 1 loads printing data, performs a left shift operation with respect thereto, and then performs the same arithmetic operation.

Thereafter, the CPU 1 continues to generate history patterns in accordance with the same algorithm from the dot Tb0 as the fourth history factor to the eighth history factor Td, thereby completing the generation of all history patterns.

Then, the CPU 1 transfers the history patterns corresponding to the individual history factors to the parallel/serial converting circuit 41. At the time at which the transfer of each one of the history patterns is completed, the CPU 1 sets, to the timer circuit 42, the history timer value which determines an application time for the history pattern and waits for the application to the immediately preceding history factor being concurrently performed to be completed.

After counting up the set history timer value, the timer circuit 42 notifies the head control signal generating circuit 43 of counting up. Upon receipt of the count-up notification from the timer circuit 42, the head control signal generating circuit 43 outputs a data latch signal to the shift register 51 in the thermal print head 5. The shift register 51 receives a data latch signal, latches the history pattern that has previously been shifted in, and drives the heat generating element 52 until the subsequent latch signal is received. The head control signal generating circuit 43 also outputs, in addition to the data latch signal, an application enable signal which enables the driving of the heat generating element 52 and a shift clock signal necessary to actually shift in the history pattern.

Figure 8:
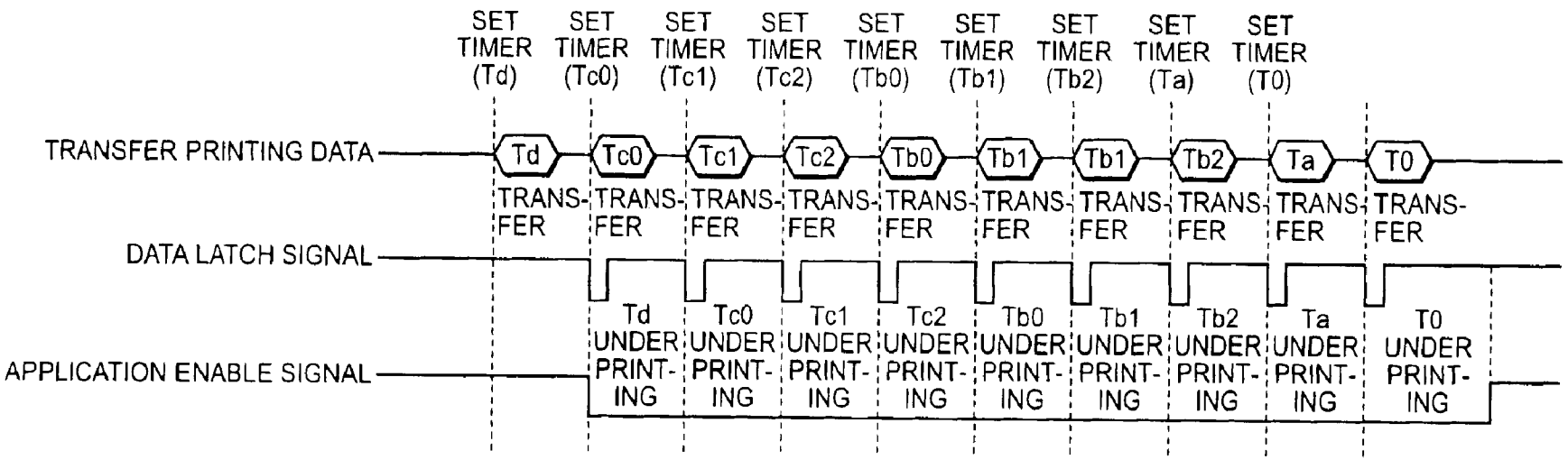
FIG. 8 is a time chart according to the present embodiment.

FIG. 8 is a time chart according to the present embodiment. It is to be noted that the order in which the history patterns are transferred, the electric logic of the application enable signal, and the number of history factors shown herein are only exemplary and not restrictive.

Figure 9:
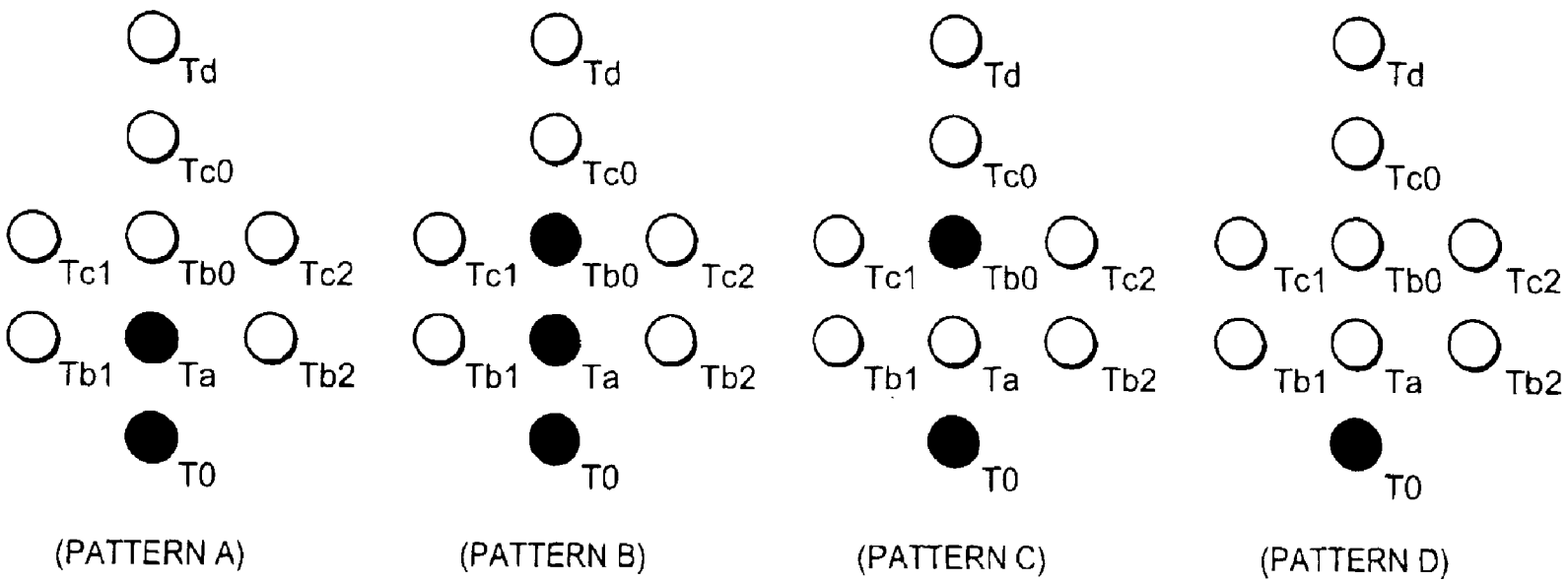
FIG. 9 is a view showing an example of a printing pattern.

The conventional heat history control is based on the principle that, if the previously printed dot is energized, the target dot is not energized simply. Actually, it is possible to control thermal energy by using only this mechanism. By way of example, however, consideration will be given to a printing pattern as shown in FIG. 9. It can theoretically be considered that the heat accumulated in the pattern B is larger in amount than the heat accumulated in the pattern A. Inmost cases, however, the fact that the 1st previous dot Ta which exerts the greatest influence of heat accumulation was printed has actually influenced the amount of accumulated heat to such a degree that the printing or non-printing of the dot Tb0 subsequent thereto is negligible in either of the patterns A and B. It can therefore be considered that the amount of accumulated heat is substantially equal at the time of printing the dot T0 in either of the patterns A and B. However, since the dot Tb0 was not printed in the pattern A, the history pattern corresponding to the dot Tb0 is generated as data indicative of energization under the heat history control so that application is performed. Consequently, there is a possibility that the concentration of the printed dot T0 is different between the patterns A and B. To circumvent the difference, it is necessary to reduce the energization time for the dot Tb0 by reducing the time allocated to the dot Tb0, i.e., the history timer value.

If the patterns C and D are observed, on the other hand, the dot Tb0 was printed in the pattern C so that it is necessary to consider the influence of heat accumulation on the dot T0. In this case, thermal energy cannot be attenuated sufficiently if the time allocated to the dot Tb0 has been reduced for the reason described above. As a result, application is performed to the dot T0 with nearly maximum energy in the pattern C in the same manner as in the pattern D. To circumvent these contradictory phenomena, therefore, the result of printing the dot Tb0 may be ignored appropriately only when the first previous dot Ta was printed. The conventional heat history control system has been incapable of flexibly performing such a process since the use of hardware has fixed a control method. A system which performs heat history control through the use of software as described in the present embodiment is capable of performing such a process and flexibly performing control in accordance with the characteristics of an individual thermal print head.

Figure 10:
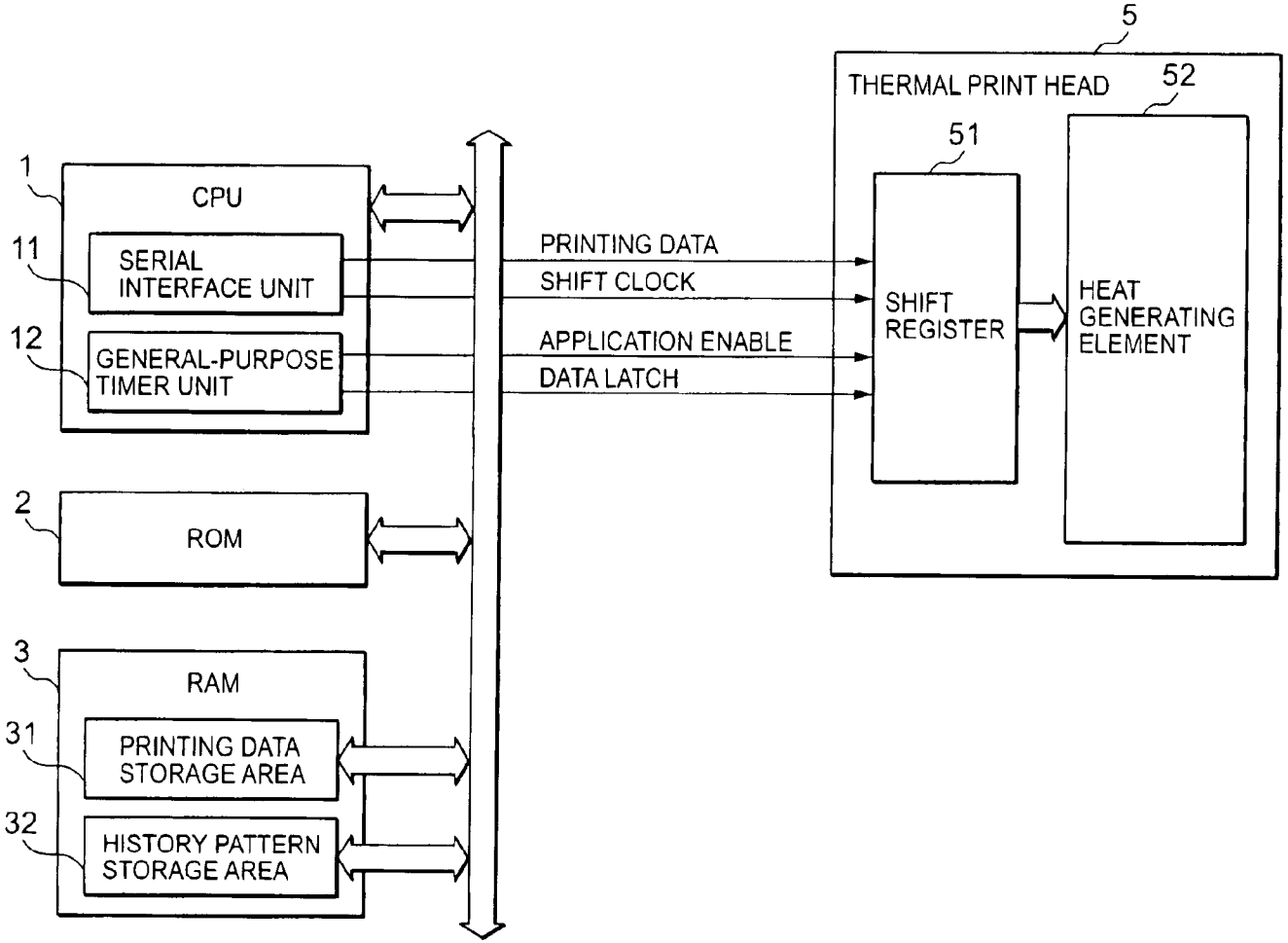
FIG. 10 is a block diagram showing an example of direct control over a thermal print head performed with a CPU.

Although the present embodiment has used the thermal print head interface LSI 4, the structure shown in FIG. 10 can be adopted depending on the CPU in use. The thermal print head 5 is controlled directly by using a serial interface unit 11 and a general-purpose timer unit 12 each provided in the CPU 1. In this case, the thermal print head interface LSI 4 is no more necessary so that a further simplified structure and lower cost are possible.

Figure 7:
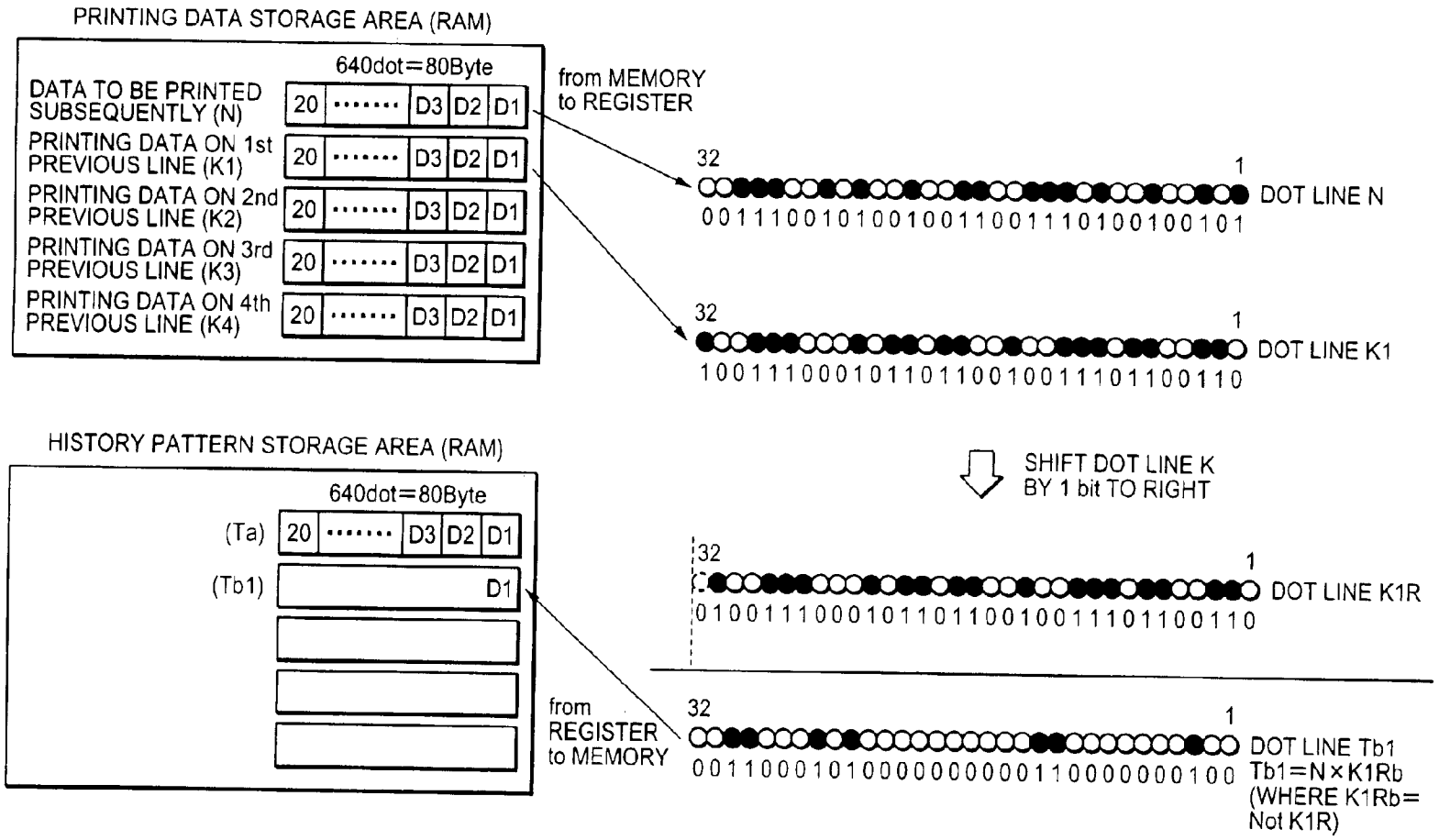
FIG. 7 is a view showing the example of the history pattern generation algorithm.

The processes shown in FIGS. 5(1) and 5(2), FIG. 6, FIG. 7, and FIG. 10 that have been described above are executed by the CPU 1 in accordance with the program stored in the ROM 2.

Thus, according to the present invention, it is no more necessary to externally provide a history pattern generation processing circuit and a mechanism for holding previous printing data so that the structure is simplified and cost is reduced.

In the case where further higher-speed printing or the like causes a necessity for higher-accuracy heat history control, a flexible response can be made.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A heat history control system comprising: a CPU; a memory; a thermal print head having a heat generating element; and a thermal print head interface unit, wherein said memory stores printing data, said CPU reads, from said memory, printing data on a target line to be printed subsequently and printing data on a plurality of immediately preceding lines, performs an arithmetic operation with respect to the read printing data to determine a history pattern, stores the determined history pattern in said memory, reads, from said memory, the history pattern of a history factor which is a dot exerting influence of heat accumulation on a target dot to be printed subsequently, transmits the read history pattern to said thermal print head interface unit, and transmits a history timer value preliminarily allocated to said history factor to said thermal print head interface unit, and said thermal print head interface unit drives said thermal print head based on said history pattern and on said history timer value.

2. The heat history control system of claim 1, wherein said thermal print head interface unit determines an energization time for the heat generating element for printing said target dot as a time obtained by subtracting said history timer value of said energized history factor from an energization time when heat history control is not performed.

3. The heat history control system of claim 1, wherein said history timer value is weighed in accordance with a degree of influence exerted by said history factor on said target dot.

4. The heat history control system of claim 1, wherein said CPU performs the arithmetic operation by ignoring a 2nd previous history factor when a 1st previous history factor immediately preceding said target dot has been energized.

5. A heat history control system comprising: a CPU; a memory; and a thermal print head having a heat generating element, wherein said memory stores printing data, said CPU reads, from said memory, printing data on a target line to be printed subsequently and printing data on a plurality of immediately preceding lines, performs an arithmetic operation with respect to the read printing data to determine a history pattern, stores the determined history pattern in said memory, reads, from said memory, the history pattern of a history factor which is a dot exerting influence of heat accumulation on a target dot to be printed subsequently, and transmits, to said thermal print head, a drive signal generated based on the read history pattern and on a history timer value preliminarily allocated to said history factor, and said thermal print head energizes the heat generating element based on said drive signal.

6. The heat history control system of claim 5, wherein said CPU determines an energization time for the heat generating element for printing said target dot as a time obtained by subtracting said history timer value of said energized history factor from an energization time when heat history control is not performed.

7. The heat history control system of claim 5, wherein said history timer value is weighed in accordance with a degree of influence exerted by said history factor on said target dot.

8. The heat history control system of claim 5, wherein said CPU performs the arithmetic operation by ignoring a 2nd previous history factor when a 1st previous history factor immediately preceding said target dot has been energized.

9. A printer comprising: a CPU; a memory; a thermal print head having a heat generating element; and a thermal print head interface unit, wherein said memory stores printing data, said CPU reads, from said memory, printing data on a target line to be printed subsequently and printing data on a plurality of immediately preceding lines, performs an arithmetic operation with respect to the read printing data to determine a history pattern, stores the determined history pattern in said memory, reads, from said memory, the history pattern of a history factor which is a dot exerting influence of heat accumulation on a target dot to be printed subsequently, transmits the read history pattern to said thermal print head interface unit, and transmits a history timer value preliminarily allocated to said history factor to said thermal print head interface unit, and said thermal print head interface unit drives said thermal print head based on said history pattern and on said history timer value.

10. The printer of claim 9, wherein said thermal print head interface unit determines an energization time for the heat generating element for printing said target dot as a time obtained by subtracting said history timer value of said energized history factor from an energization time when heat history control is not performed.

11. The printer of claim 9, wherein said history timer value is weighed in accordance with a degree of influence exerted by said history factor on said target dot.

12. The printer of claim 9, wherein said CPU performs the arithmetic operation by ignoring a 2nd previous history factor when a 1st previous history factor immediately preceding said target dot has been energized.

13. A printer comprising: a CPU; a memory; and a thermal print head having a heat generating element, wherein said memory stores printing data, said CPU reads, from said memory, printing data on a target line to be printed subsequently and printing data on a plurality of immediately preceding lines, performs an arithmetic operation with respect to the read printing data to determine a history pattern, stores the determined history pattern in said memory, reads, from said memory, the history pattern of a history factor which is a dot exerting influence of heat accumulation on a target dot to be printed subsequently, generates a drive signal based on the read history pattern and on a history timer value preliminarily allocated to said history factor, and transmits the generated drive signal to said thermal print head, and said thermal print head applies a voltage to the heat generating element based on said drive signal.

14. The printer of claim 13, wherein said CPU determines an energization time for the heat generating element for printing said target dot as a time obtained by subtracting said history timer value of said energized history factor from an energization time when heat history control is not performed.

15. The printer of claim 13, wherein said history timer value is weighed in accordance with a degree of influence exerted by said history factor on said target dot.

16. The printer of claim 13, wherein said CPU performs the arithmetic operation by ignoring a 2nd previous history factor when a 1st previous history factor immediately preceding said target dot has been energized.

17. A program allowing a computer to perform the process steps of:

reading, from a memory, printing data on a target line to be printed subsequently and printing data on a plurality of immediately preceding lines;

performing an arithmetic operation with respect to the read printing data to determine a history pattern;

storing the determined history pattern in said memory;

reading, from said memory, the history pattern of a history factor which is a dot exerting influence of heat accumulation on a target dot to be printed subsequently;

transmitting the read history pattern to a thermal print head interface unit; and transmitting a history timer value preliminarily allocated to said history factor to said thermal print head interface unit.

18. The program of claim 17, wherein said history timer value is weighed in accordance with a degree of influence exerted by said history factor on said target dot.

19. The program of claim 17, wherein said CPU performs the arithmetic operation by ignoring a 2nd previous history factor when a 1st previous history factor immediately preceding said target dot has been energized.

20. A program allowing a computer to perform the process steps of:

reading, from a memory, printing data on a target line to be printed subsequently and printing data on a plurality of immediately preceding lines;

performing an arithmetic operation with respect to the read printing data to determine a history pattern;

storing the determined history pattern in said memory;

reading, from said memory, the history pattern of a history factor which is a dot exerting influence of heat accumulation on a target dot to be printed subsequently; and transmitting, to a thermal print head, a drive signal generated based on the read history pattern and on a history timer value preliminarily allocated to said history factor.

21. The program of claim 20, wherein a time for said drive signal is determined as a time obtained by subtracting said history timer value of said energized history factor from an energization time when heat history control is not performed.

22. The program of claim 20, wherein said history timer value is weighed in accordance with a degree of influence exerted by said history factor on said target dot.

23. The program of claim 20, wherein said CPU performs the arithmetic operation by ignoring a 2nd previous history factor when a 1st previous history factor immediately preceding said target dot has been energized.

* * * * *